US009185934B2

(12) United States Patent
Guenter et al.

(10) Patent No.: US 9,185,934 B2
(45) Date of Patent: Nov. 17, 2015

(54) DEVICE AND METHOD FOR SUPPLYING GROUND OR CUT TOBACCO MATERIAL TO A PORTIONING DEVICE

(75) Inventors: Lutz Guenter, Elmenhorst (DE); Joern Punzius, Trittau (DE); Joerg Wittek, Hamburg (DE); Andreas Panz, Geesthacht (DE); Christofer Overbeck, Schmilau (DE)

(73) Assignee: HAUNI MASCHINENBAU AG, Hamburg (DE)

( * ) Notice: Subject to any disclaimer, the term of this patent is extended or adjusted under 35 U.S.C. 154(b) by 1217 days.

(21) Appl. No.: 13/111,410

(22) Filed: May 19, 2011

(65) Prior Publication Data

US 2011/0284016 A1 Nov. 24, 2011

(30) Foreign Application Priority Data

May 21, 2010 (DE) ..... 10 2010 029 243

(51) Int. Cl.
*A24C 5/39* (2006.01)
*A24B 13/00* (2006.01)

(52) U.S. Cl.
CPC ..... *A24C 5/396* (2013.01); *A24B 13/00* (2013.01); *A24C 5/39* (2013.01)

(58) Field of Classification Search
CPC ..... A24C 5/39; A24C 5/396; A24B 1/10
USPC ..... 131/324
See application file for complete search history.

(56) References Cited

U.S. PATENT DOCUMENTS

| | | | | |
|---|---|---|---|---|
| 2,776,916 | A * | 1/1957 | Ericsson | 131/352 |
| 3,310,156 | A | 3/1967 | Nowak, Jr. | |
| 3,402,722 | A | 9/1968 | Kochalski | |
| 4,185,644 | A * | 1/1980 | Heitmann et al. | 131/109.3 |
| 4,616,663 | A | 10/1986 | Lorenzen et al. | |
| 7,584,758 | B2 | 9/2009 | Focke et al. | |
| 2006/0096606 | A1 | 5/2006 | Focke et al. | |
| 2010/0018539 | A1 | 1/2010 | Brinkley et al. | |
| 2010/0051041 | A1 | 3/2010 | Boldrini | |

FOREIGN PATENT DOCUMENTS

| | | |
|---|---|---|
| DE | 32 02 717 | 9/1982 |
| DE | 34 38 125 | 5/1985 |
| DE | 3438125 | 5/1985 |
| DE | 10251210 | 5/2004 |

OTHER PUBLICATIONS

German Office Action dated Jul. 4, 2011 conducted in counterpart German Appln. No. 10 2010 029 243.5.

European Office Action conducted in counterpart European Appln. No. 11 166 205 dated Nov. 6, 2013.

Search Report/Office Action from E.P.O. in counterpart European Patent Application No. 11166205.2 on Sep. 20, 2011.

* cited by examiner

*Primary Examiner* — Anthony Calandra
(74) *Attorney, Agent, or Firm* — Greenblum & Bernstein, P.L.C.

(57) ABSTRACT

A device of the tobacco processing industry and method for supplying ground or cut tobacco material having at least 35% moisture content. The device includes a conveyor, a portioner, and a homogenizer device including a needle roller and a picker roller. The needle roller is located downstream, relative to a tobacco conveying direction, of the conveyor and is structured and arranged to receive tobacco material from the conveyor, and the picker roller is structured and arranged to expel tobacco material out of the needle roller in a direction of the portioner.

13 Claims, 2 Drawing Sheets

Fig. 3
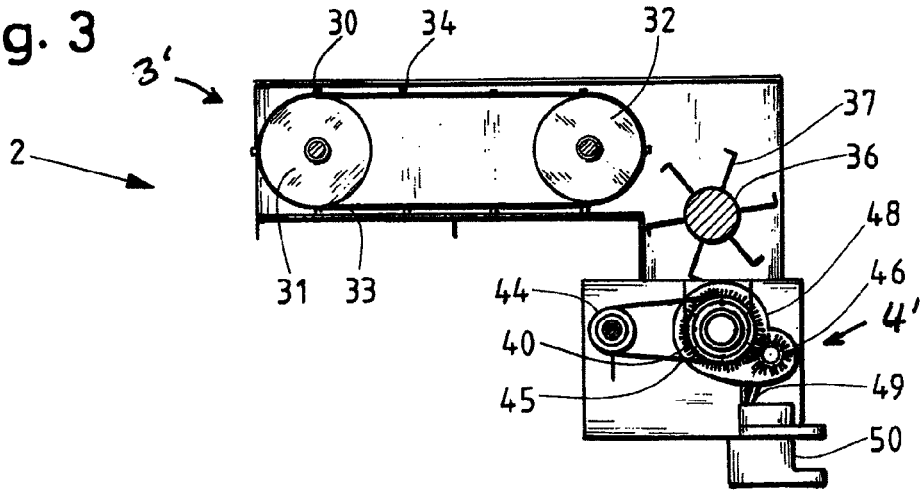
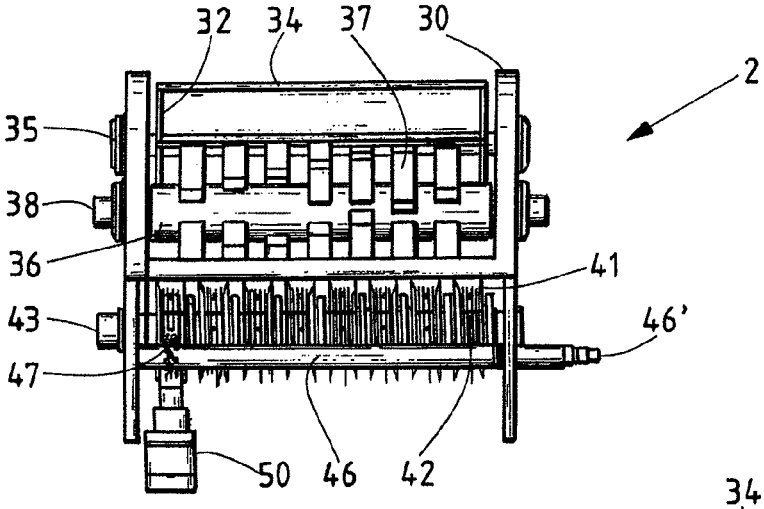
Fig. 4
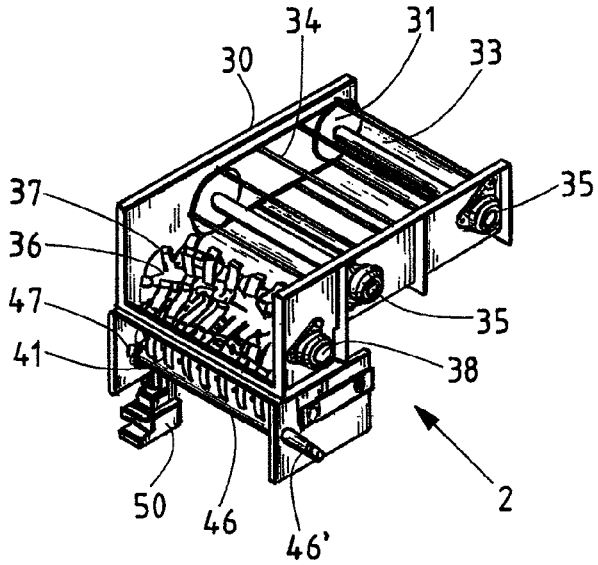
Fig. 5

DEVICE AND METHOD FOR SUPPLYING GROUND OR CUT TOBACCO MATERIAL TO A PORTIONING DEVICE

CROSS-REFERENCE TO RELATED APPLICATIONS

The present application claims priority under 35 U.S.C. §119(a) of German Patent Application No. 10 2010 029 243.5 filed May 21, 2010, the disclosure of which is expressly incorporated by reference herein in its entirety.

BACKGROUND OF THE INVENTION

1. Field of the Invention

The invention relates to a device of the tobacco processing industry for supplying ground or cut tobacco material having at least 35% moisture content to a portioning device. The device includes a conveyor device, a homogenizing device and a portioning device. The invention further relates to a method for supplying ground or cut tobacco material having at least 35% moisture content to a portioning device, in which ground tobacco material is supplied by a conveyor device to a homogenizing device, and a use of a homogenizing device.

2. Discussion of Background Information

The invention therefore relates to the field of processing and portioning of ground or cut tobacco material having high moisture content. The tobacco material may include ground or cut tobacco and possibly additives. Here, the cut length is short so that the cut moist tobacco material has a consistency comparable to that of ground moist tobacco material. Such moist ground or cut tobacco material is offered as so-called "SNUS" tobacco or smokeless tobacco, and is used orally, i.e., in the oral cavity. SNUS tobacco has a moistness of approximately 35% to 50% or more, and is a fine-grained, clumpy substance that has a consistency similar to that of moist coffee grounds.

For consumption, SNUS tobacco in some cases has added flavorings, for instance, menthol, ammonium chloride (salmiac) or other flavors, and is packaged in portions of 0.5 to 2 grams in so-called SNUS bags. This so-called "pouch" is a porous paper that is sealed all around, but is water permeable, and dispenses the contents of the pouch to the area of the mouth and the mucous membranes of the mouth. The most common portion size is approximately 1 gram per portion. After consumption, the pouch is removed from the mouth, and disposed of.

Because a ground or, in particular, short, cut tobacco material having a moisture content of 35% or more is very clumpy as a fine-grained loose material, it is difficult to process. From the prior art, it is known to process the tobacco material having a lower moisture, as such lower moisture tobacco material does not clump, and to fill portion bags or pouches with the processed lower moisture tobacco material. In a subsequent processing step, the portion bags are then moistened in order to bring the tobacco material to the desired moisture. Because during this wet treatment, contents are leached out of the tobacco material, these permeate into the also wet, porous paper of the portion bag and stain it non-uniformly. To conceal this, in some cases, black or dark paper is used, so that the corresponding staining is less noticeable.

In alternate known methods, the ground or cut tobacco material is processed in a moist state. For this purpose, the loose material is sieved. However, sieving of a ground tobacco material having a moisture content of 35% or more is associated with the formation of bridges of clumped material in the sieve such that the sieves and additional components of the corresponding processing devices must be thoroughly cleaned on a regular basis.

Homogenizing, such as is achieved through sieving, is very important in the processing of moist fine-grained loose material that has a tendency to clump, because only in this manner can it be guaranteed that a reproducibly consistent quantity of tobacco material is contained in each portion bag. The requirements on the constancy of the portion bag contents are approximately 5%, which means that with a portion bag having contents of approximately one gram, the accuracy of the filled contents is approximately 0.05 grams. Slight clumps in moist ground or cut tobacco materials lend themselves to exceeding these tolerances during portioning, which results in an undesired rejection of the portion bags due to exceeding or falling below the weight tolerance.

Devices for portioning and filling homogenized, moist, ground or cut tobacco material into portion bags are known. A corresponding device is sold by the MediSeal GmbH company under the name TS 1000. In this device, the tobacco material is filled into a pre-dosing chamber and subsequently filled into an open portion bag that is subsequently sealed.

SUMMARY OF THE EMBODIMENTS

Starting from this prior art, embodiments of the present invention homogenize ground or cut tobacco material having a moistness of at least 35%, in order to be able to subsequently fill it into portion bags. A good homogenization is to be attained with low maintenance and cleaning effort.

Accordingly, embodiments are directed to a device of the tobacco processing industry for supplying ground or cut tobacco material having at least 35% moisture content to a portioning device. The device includes a conveyor device, a homogenizing device, and a portioning device. The homogenizing device includes a combination of a needle roller and a picker roller, in which the needle roller is disposed downstream of the conveyor device to receive material from the conveyor device. The picker roller is designed to expel tobacco material out of the needle roller in the direction of the portioning device.

The invention is based on the fundamental idea that a combination of needle roller and picker roller can be used for homogenizing and possibly dosing of moist and clumped ground or cut tobacco material. The moist ground or cut tobacco material is removed or accepted from an upstream connected unit or out of a reservoir by a conveyor device and supplied to the homogenizing device. The moist ground or cut tobacco material has a clumped consistency that is reminiscent of moist coffee grounds. Within the homogenizing device, the needle roller receives the tobacco material. During this process, the intermediate space between the pins on the surface of the needle roller is filled with the material up to the height of the needles of the needle roller. This makes a controlled volume flow of the ground tobacco material possible. At this location, the tobacco material also still has its clumped consistency and is held and conveyed by the needles of the needle roller.

Surprisingly, it has been found that a combination of a needle roller and a picker roller leads to an effective homogenizing of the ground or cut tobacco material having a moistness of at least 35% due to the combination, and that the clumping between the grains or short fibers of the tobacco material is broken up. This was not to be expected because the clumping up to now could only be broken up by the use of finely meshed sieves, and the needles or other striking instruments of the picker roller nowhere nearly approximate the fineness of the sieves used up to now. Thus, it was not to be expected that a picker roller in combination with a needle roller would lead to an effective homogenizing of the moist tobacco material.

The homogenizing occurs therefore by the interaction of the needle roller and the picker roller. The picker roller rotates with a higher circumferential speed than the needle roller and in the opposite direction to the rotational direction of the needle roller. With its own pins, bars, scrapers and similar elements, the picker roller combs out the tobacco material between the needles of the needle roller. Because this occurs at high speed, the bonds between the grains of fine-grained, moist tobacco material are broken up so that individual grains or fibers of the tobacco material are accelerated in the direction of the portioning device. In the process, clumps are reliably broken up.

Using this solution according to the embodiments, the problem occurring with sieving, i.e., clumps and bridges form over the sieve, is avoided such that cleaning of a sieve can be omitted due to the absence of a sieve. The combination of needle roller and picker roller is to a large extent self-cleaning such that time-consuming and close-meshed cleaning cycles and maintenance cycles can be omitted.

In a particular embodiment, if a control device is provided with which the rotational speed of the needle roller and/or the rotational speed of the picker roller is controllable, a particularly good homogenizing and dosing is possible. In this regard, the rotational speed of the needle roller regulates the delivery rate, i.e., the volume flow of ground or cut tobacco materials, while the rotational speed of the picker roller is related to the degree of homogenization. The homogenizing and dosing however is also related to the respective other rotational speed.

To ensure an efficient supply of homogenized tobacco material to the portioning device, a vibratory conveyor is preferably provided beneath or downstream of the combination of a needle roller and a picker roller, and arranged collinear with a needle roller axle, where in particular, further vibratory conveyers are transversely attached at the vibratory conveyor. The ground or cut tobacco material grains or short fibers that were separated from each other, are kept separately from each other by a vibratory conveyor that prevents clumping and ensures an efficient conveying of the homogenized tobacco material to the entrance of the portioning device, which according to embodiments, may also include multiple portioning devices.

Advantageously, a return mechanism for non-portioned ground or cut tobacco material is provided. Due to the engagement of the striking elements of the picker roller with the needles of the needle roller, the combination of needle roller and picker roller has a comparatively wide spatial area in which the tobacco material is expelled. Therefore, this possibly results in a portion of the tobacco material that after being expelled from the needle roller by the picker roller does not arrive in a portioning device. This excess tobacco material can include up to 50% of the conveyed tobacco material so that it is advantageous to provide a return mechanism, in particular, to the conveyor device upstream of the homogenizing device. This can take place using belt conveyors, chain conveyors or similar devices. In this context, a pneumatic conveyance is also possible, but it should be ensured that the moisture of the returned tobacco material is not, or not significantly, reduced during the process. It does not matter that, during the return process, the excess tobacco material is still homogenized.

In a preferred further development, it is provided that the needle roller includes a plurality of needle roller segments that are disposed on a common drive axle and/or the picker roller includes a plurality of picker roller segments that are disposed on a common drive axle. The needle roller segments and/or the picker roller segments are arranged to align with the reception part of the portioning device. By the segments, the needle roller or the picker roller is divided along its longitudinal extension into individual partial areas which respectively correspond to a reception part of a segmented portioning device or to the reception parts of several portioning devices, and ground or cut tobacco material in the homogenized and dosed state is filled into these. In this manner, the otherwise arising excess is significantly reduced.

If in this case, the needle roller segments and/or picker roller segments can advantageously be driven, switched, and/or controlled independently from each other, multiple production lines for portion bags with SNUS tobacco can be controlled independently of each other. In this manner, over the entire width of the device in accordance with embodiments, the specified production tolerances and production parameters can be maintained. If, for example, due to geometric parameters, less tobacco material arrives at the edge of the portioning devices than in the center, then in this case a portioning device in the center can be operated with a higher speed and a higher frequency than a portioning device at the edge. Nevertheless, all portion bags include content within the specified tolerances. Likewise, the different segments can be controlled such that variations over the width of the rollers are compensated.

A possible approach for the independent operation is, for example, that individual needle roller segments are operated on a common axle, but can be separately decoupled from this axle. They can also each include their own drive or gear ratios with respect to a common drive axle.

An even more exact dosing may be advantageously attained if a further combination of a needle roller and a picker roller is disposed downstream of the combination of a needle roller and a picker roller. In this case, the second combination of the needle roller and picker roller, by conveying already homogenized tobacco material of constant density, effectuates a more exact dosing of the tobacco material. By control of the second combination of needle roller and picker roller, it is possible to equalize possibly occurring fluctuations that could not be caught by the first combination.

The embodiments of the invention are directed to a method for supplying ground or cut tobacco material having a moisture content of at least 35% to a portioning device. The method includes ground or cut tobacco material supplied by a conveying device to a homogenizing device, in which the tobacco material is homogenized in the homogenizing device by a combination of a needle roller and a picker roller. The needle roller with its needles receives tobacco material from the conveyor device and conveys it further up to the picker roller, and the picker roller expels the tobacco material out of the needles of the needle roller in the direction of a portioning device.

Within the scope of the invention, the wording "out of the needles of the needle roller" means that the tobacco material that is located between the needles of the needle roller in the combined and possibly clumped state and that is held by the needles is expelled. This method, according to embodiments, is also based on the fundamental idea that surprisingly, the needles and striking elements of the needle roller and the picker roller that are wider spaced relative to the particle size result in an effective homogenizing of the material.

The selection of the conveyed volume and the homogenization also leads to a dosing of the ground or cut tobacco material of high moistness.

Preferably, a rotational speed of the needle roller and/or a rotational speed of the picker roller can be controlled by a control device. By this, the homogenizing and the dosing as well as the volume flow can be adapted to fluctuations in the feed material.

According to a particular embodiment, if the needle roller includes a plurality of needle roller segments which are disposed on a common drive axle and/or the picker roller includes a plurality of picker roller segments which are disposed on a common drive axle, such that, by the needle roller segments and/or picker roller segments ground or cut tobacco material is expelled into the reception part of the portioning device, then a process control adaptable across the width of the device can be attained having low excess and also low rejects with constant quality and filling within the specified tolerances.

For this purpose, it is particularly preferred that the needle roller segments and/or the picker roller segments are driven, switched and/or controlled independently from each other.

A particularly exact and constant homogenizing and dosing is attained when the ground or cut tobacco material, homogenized by the combination of needle roller and a picker roller is advantageously dosed by a further combination of a needle roller and a picker roller.

Finally, embodiments are directed to a method of using a homogenizing device having a combination of a needle roller and a picker roller for homogenizing ground or cut tobacco material having a moisture content of at least 35%. An additional combination of needle roller and picker roller can be advantageously arranged for dosing.

Embodiments of the invention are directed to a device of the tobacco processing industry for supplying ground or cut tobacco material having at least 35% moisture content. The device includes a conveyor, a portioner, and a homogenizer device including a needle roller and a picker roller. The needle roller is located downstream, relative to a tobacco conveying direction, of the conveyor and is structured and arranged to receive tobacco material from the conveyor, and the picker roller is structured and arranged to expel tobacco material out of the needle roller in a direction of the portioner.

According to features of the embodiments, a controller can be structured and arranged to control the rotational speed of at least one of the needle roller and the picker roller.

In accordance with other features of the embodiments of the invention, the device can further include a vibratory conveyor that is positioned downstream, relative to the tobacco conveying direction, of the needle roller and the picker roller, and collinear to an axis of the needle roller. Further, additional vibratory conveyers may be arranged transversely to the vibratory conveyor.

According to further features, the device can also include a return mechanism arranged to return non-portioned ground or cut tobacco material for supplying to the conveyor.

In accordance with still other features of the embodiments, the portioner may include a reception part and at least one of: the needle roller can include a plurality of needle roller segments that are arranged on a common drive axle, such that the needle roller segments are aligned with the reception part; and the picker roller can include a plurality of picker roller segments that are arranged on a common drive axle, such that the picker roller segments are aligned with the reception part. Further, the at least one of the needle roller segments and the roller picker segments may be at least one of drivable, switchable and controllable independently of each other.

According to still further features, the device can include a second needle roller and a second picker roller arranged in combination downstream, relative to the tobacco conveying direction, of the needle roller and the picker roller.

Embodiments of the invention are directed to a method for supplying ground or cut tobacco material having at least 35% moisture content to a portioner. The method includes supplying, from a conveyor, ground or cut tobacco material to a homogenizer that includes a combination of a needle roller and a picker roller, and homogenizing the tobacco material in the homogenizer by receiving, in needles of the needle roller, the tobacco material from the conveyor, supplying the tobacco material to the picker roller, expelling, via the picker roller, the tobacco material out of the needles and in a direction of the portioner.

According to aspects of the embodiments, the method can further include controlling at least one of a rotational speed of the needle roller and a rotational speed of the picker roller with a controller.

In accordance with other aspects of the embodiments of the instant invention, the portioner may include a reception part and at least one of: the needle roller comprises a plurality of needle roller segments that are arranged on a common drive axle, and the picker roller comprises a plurality of picker roller segments that are arranged on a common drive axle. The method can also include expelling, via the at least one of the plurality of needle roller segments and the plurality of picker roller segments, the ground or cut tobacco material into the reception part. Further, the method may include at least one of independently driving, switching, and controlling the at least one of the plurality of needle roller segments and the plurality of roller picker segments.

According to still other aspects of the embodiments, the method can include dosing the homogenized ground or cut tobacco material in a combination of a second needle roller and a second picker roller.

Embodiments of the invention are directed to a method of using a tobacco material homogenizer that comprises a combination of a needle roller and a picker roller. The method includes dosing homogenized ground or cut tobacco material having a moisture content of at least 35%.

Embodiments of the invention are directed to a method of operating the above-described device. The method includes receiving, in needles of the needle roller, the tobacco material from the conveyor, and expelling, via the picker roller, the tobacco material out of the needles.

According to aspects of the embodiments of the invention, the method can further include dosing the expelled tobacco material into the portioner. Further, the portioner may include a plurality of portioning segments and the method can further include dosing the expelled tobacco material into the plurality of portioning segments.

Embodiments of the invention are directed to a method of operating the above-described device, in which the needle roller includes a plurality of needle roller segments and the picker roller includes a respective plurality of picker roller segments aligned with the plurality of needle roller segments. The method includes receiving, in needles of the plurality of needle roller segments, the tobacco material from the conveyor, and expelling, via the plurality of picker roller segments, the tobacco material out of the needles of the needle roller segments.

According to other features of the embodiments, the portioner may include a plurality of portioning segments aligned with the plurality of picker roller segments, and the tobacco material expelled via the plurality of picker roller segments can be respectively directed to the plurality of portioning segments.

In accordance with still yet other features of the embodiments of the present invention, the method can further include dosing the tobacco material into the needles of the plurality of needle roller segments.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 3 schematically illustrates a lateral view of a further apparatus according to the invention;

FIG. 4 schematically illustrates a top view of the device according to FIG. 3;

FIG. 5 schematically illustrates a perspective representation of the device according to FIG. 3.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
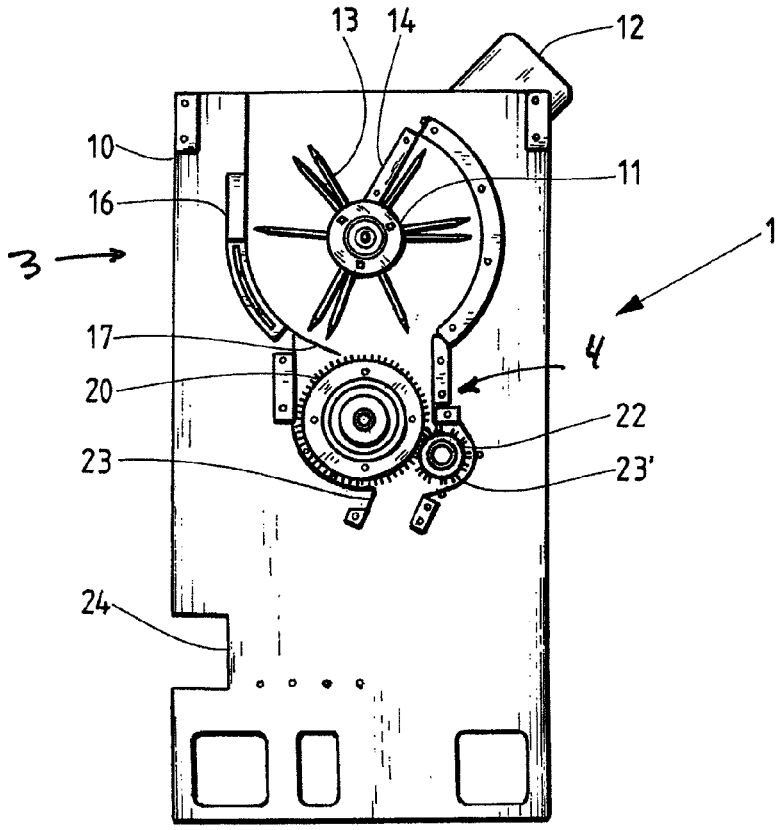
FIG. 1 schematically illustrates a lateral view of an apparatus according to the invention.

FIG. 1 shows a lateral representation of a feeding device 1 (or device) according to embodiments of the invention for supplying ground or cut tobacco material having at least 35% moisture content to a portioning device (not shown, but see element 50 in FIGS. 3-5). In a housing 10, a conveying device 3, having an axle 11 and feed fingers 13 which stick out from axle 11, is shown in an upper area of feeding device 1. Axle 11 of conveyor device 3 is driven by a drive 12 which is represented partially covered by housing 10. Conveying device 3 is partially enclosed in housing 10 and includes a wall 16 and an opposite wall. Housing 10 is partially open toward the top and toward the bottom. In addition, a slotted slide plate 14 is disposed in an upper region of feeding device 1, such that a hopper shaped opening arises between wall 16 and slotted slide plate 14. In FIG. 1, conveying device 3 and its axle 11 have a counterclockwise direction of rotation.

Connected and clumped tobacco material, not shown in FIG. 1, arrives via a guide plate 17 to a homogenizing device 4 with a needle roller 20 having short and sharp needles along its periphery. The height of the needles and the width and rotational speed of needle roller 20 determine a volume flow of the conveyed ground or cut moist tobacco material. In FIG. 1, the needle roller 20 rotates in a clockwise direction.

After a rotation of needle roller 20 by approximately 110°, tobacco material after the acceptance from conveying device 3 into the needles of needle roller 20, arrives at a picker roller 22, which has striking elements, e.g., barbs or similar elements that rotate at high speed in a counter clockwise direction. Additionally, picker roller 22 comprises a drive, not shown. The striking elements engage between the needles of needle roller 20 and expel the tobacco material conveyed therein at high-speed. Because the tobacco material is already very fine grained, the tobacco material is not damaged by this. The high speed with which the striking elements hit the tobacco material leads, however, to the fact that connectivity caused by the moistness of the grains or short fibers of the tobacco material is broken, and the tobacco material is homogenized. The tobacco material is expelled substantially tangentially to the surface of needle roller 20 and picker roller 22, such that, at this location, the tobacco material falls downward through a channel delimited by walls 23, 23' of homogenizing device 4.

A portioning device is not represented in FIG. 1, however, a reception part 24 for a portioning device is represented in FIG. 1.

Figure 2:
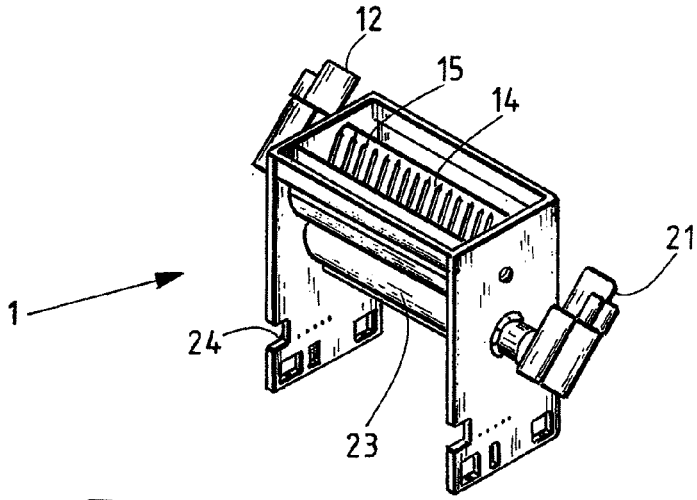
FIG. 2 schematically illustrates a perspective representation of the device according to the invention according to FIG. 1.

FIG. 2 shows the device 1 according to FIG. 1 in a schematic perspective representation. Along with a drive 12 for conveying device 3, a drive 21 for needle roller 20 is also represented. In the upper area of feeding device 1, an opening can be recognized into which moist ground or cut tobacco material is filled, as well as a slotted slide plate 14 having slots 15 which represents a part of a hopper for filling conveying device 3. Feed fingers 13 on axle 11 of conveying device 3, shown in FIG. 1, penetrate slots 15 in slide plate 14 so that tobacco material cannot fall through slots 15. Wall 23 of homogenizing device 4 can be seen in a lower area. The area disposed further below comprises a reception part 24 for a portioning device that is not represented in FIG. 2.

FIG. 3 shows a lateral view of a schematic representation of an embodiment of a feeding device 2, which is an alternative variant of feeding device 1 depicted in FIGS. 1 and 2. It comprises a horizontally aligned conveyor device 3' in the shape of a conveyor belt 33 that runs over two feed rollers 31 and 32. Conveyor device 3' can be arranged in an upper housing 30 that is L-shaped when viewed laterally. An outside or outer periphery of conveyor belt 33 can include ribs 34 arranged at regular intervals so that moist ground or cut tobacco material can be supported on top of conveyor belt 33 and conveyed, as shown in FIG. 3, from left to right. From conveyor belt 33, the tobacco material arrives on or is deposited onto feed shovels 37 extending from feed roller 36, which, as depicted in FIG. 3, rotates in a counterclockwise direction.

The tobacco material is deposited by shovels 37 through an opening above a homogenizing device 4' to fall into the needles of needle roller 40, which, as depicted in FIG. 3, rotates in a clockwise direction and is driven by a needle roller drive 44 via a drive belt 45. Needle roller 40 is arranged in combination with a picker roller 46, such that picker roller 46 is disposed downstream of needle roller 40, relative to the conveyor path of the tobacco material, and thereby, also arranged downstream of the point at which needle roller 40 receives the tobacco material. Needle roller 40 and picker roller 46 are located in a common housing or a common wall 48 of homogenizing device 4'.

Picker roller 46, which can be rotatably driven by a drive (not shown), expels or removes the transported moist tobacco material out of needle roller 40 in the direction of a portioning device 50. More particular, the tobacco material can be hurled by picker roller 46 through a feed hopper 49 to portioning device 50. In this manner, the tobacco material is homogenized and dosed.

FIG. 4 shows a schematic front view of feeding device 2 depicted in FIG. 3, where it can be seen that feeding device 2 is segmented along its width. Conveying device 3' is represented at the top and comprises a feed roller 32 having a conveyor belt 33 and ribs 34. Feed roller 32 is supported in an axle bearing 35 in housing 30, and feed roller 36 includes conveyor shovels 37, which are laterally offset from each other and positioned in a staggered arrangement relative to each other about the periphery of feed roller 36.

Located beneath conveying device 3', there is a segmented needle roller 40 having eight needle roller segments 41, which are disposed equally spaced next to each other. Each needle roller segment 41 comprises needles 42 at its periphery that serve for retaining and transporting the still non-homogenized, moist ground or cut tobacco material. Needle roller 40 is supported on a needle roller axle 43.

In the front view shown in FIG. 4, located somewhat beneath and in front of needle roller 40, a picker roller 46, which is also segmented, is located. For the sake of clarity and ease of explanation, only the left hand-most segment of picker roller 46 in FIG. 4 is illustrated to show picker roller spikes 47 arranged to align with needles 42 of corresponding segments 41 of needle roller 40. However, it is understood that similar arrangements of picker roller spikes 47 are provided in the other segments of the picker roller 46. Picker roller 46 comprises an axle 46' that is supported in housing 30. A drive for picker roller 46 can be provided, e.g., on a right side of axle 46' as depicted in FIG. 4.

In the lower area of feeding device 2, as depicted in FIG. 4, a portioning device 50 is schematically illustrated. While each segment 41 of needle roller 40 can be associated with a portioning device 50 in the complete device, only one such portioning device 50 is illustrated for purposes of clarity and ease of explanation. Therefore, according to the embodiment of FIG. 4, feeding device 2 includes eight portioning devices 50, which can be similar to each other. Moreover, using suitable control elements, control segments 41 of needle roller 40 can be operated or controlled separately from each other.

FIG. 5 shows a schematic perspective representation of feeding device 2 depicted in FIGS. 3 and 4. Ground or cut, moist tobacco material, which is not represented, is conveyed from above right on conveyor belt 33 towards the left to feed roller 36 having feed shovels 37 that convey the moist tobacco material to needle roller 40 located below. Needle roller 40 can include eight needle roller segments 41. While not shown in this figure, it is understood that each of the segments of picker roller 46 include picker roller spikes 47. Moreover, while only one portioning device 50 is shown beneath a segment of picker roller 46, it is understood that additional portioning devices can be arranged beneath other segments of picker roller 46 to receive a dosed amount of the homogenized moist tobacco material.

All named characteristics, including those taken from the drawings alone, and individual characteristics, which are disclosed in combination with other characteristics, are considered alone and in combination as important to the invention. Embodiments according to the invention can be fulfilled through individual characteristics or a combination of several characteristics.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE LIST

1, 2 Feeding device
10 Housing
11 Axle of the feeding device
12 Drive of the feeding device
13 Feed finger
14 Slotted slide plate
15 Slot
16 Wall
17 Guide plate
20 Needle roller
21 Drive of the needle roller
22 Picker roller
23, 23' Wall of the homogenizing device
24 Reception part for a portioning device
30 Housing
31, 32 Feed roller
33 Conveyor belt
34 Rib
35 Axle bearing
36 Feed roller
37 Feed shovel
38 Axle bearing
40 Needle roller
41 Needle roller segment
42 Needles
43 Needle roller axle
44 Needle roller drive
45 Drive belt
46 Picker roller
46' Axle
47 Picker roller spike
48 Wall of the homogenizing device
49 Feed hopper
50 Portioning device

What is claimed:

1. A method for supplying moist ground or cut tobacco material having at least 35% moisture content to a portioner, comprising:

supplying, from a conveyor, ground or cut tobacco material with a moisture content of at least 35% to a homogenizer that includes a combination of a needle roller and a picker roller;

homogenizing the tobacco material in the homogenizer by:

receiving, in needles of the needle roller, the tobacco material from the conveyor;

supplying the tobacco material to the picker roller;

expelling, via the picker roller, the tobacco material out of the needles and in a direction of the portioner, whereby the portioner is arrange to receive the homogenized, moist tobacco material and to receive a portion bag to be filled with the received homogenized, moist tobacco material.

2. The method in accordance with claim 1, further comprising controlling at least one of a rotational speed of the needle roller and a rotational speed of the picker roller with a controller.

3. The method in accordance with claim 1, wherein the portioner comprises a reception part and at least one of:

the needle roller is divided into a plurality of needle roller segments adjacently arranged on a common drive axle; and the picker roller is divided into a plurality of picker roller segments that are arranged on a common drive axle, wherein each of the plurality of picker roller segments are arranged to engage with respective segments of the plurality of picker roller segments; and the method further comprises expelling, via the at least one of the plurality of needle roller segments and the plurality of picker roller segments, the ground or cut tobacco material into the reception part, whereby the reception cart is arrange to receive homogenized, moist tobacco material from the picker roller segments and the portioner is arranged to receive at least one portion bag to be filled with the homogenized, moist tobacco material received in the reception part.

4. The method in accordance with claim 3, further comprising at least one of independently driving, switching, and controlling the at least one of the plurality of needle roller segments and the plurality of roller picker segments.

5. The method in accordance with claim 1, further comprising dosing the homogenized ground or cut tobacco material in a combination of a second needle roller and a second picker roller.

6. The method according to claim 3, wherein the portioner comprises a plurality of portioning segments having respective reception part segments that are aligned with respective picker roller segments, and the method further comprises:

receiving, in the respective reception part segments of each of the plurality of portioning segments, the homogenized, moist tobacco material expelled by the respective picker roller segments.

7. A method of operating a tobacco processing industry apparatus for supplying moist ground or cut tobacco material having at least 35% moisture content, the apparatus including a conveyor, a portioner, and a homogenizer device having a needle roller and a picker roller, in which the needle roller is located downstream, relative to a tobacco conveying direction, of the conveyor to receive tobacco material from the conveyor, and the picker roller is arranged to expel tobacco material out of the needle roller in a direction of the portioner, the method comprising:

receiving, in needles of the needle roller, the tobacco material having a moisture content of at least 35% from the conveyor; and expelling, via the picker roller, the tobacco material out of the needles, whereby the portioner is arrange to receive homogenized, moist tobacco material from the picker roller and to receive a portion bag to be filled with the received homogenized, moist tobacco material.

8. The method in accordance with claim 7, further comprising dosing the expelled tobacco material into the portioner.

9. The method in accordance with claim 8, wherein the portioner comprises a plurality of portioning segments and the method further comprises dosing the expelled tobacco material into the plurality of portioning segments.

10. A method of operating a tobacco processing industry apparatus for supplying moist ground or cut tobacco material having at least 35% moisture content, the apparatus including a conveyor, a portioner, and a homogenizer device having a needle roller and a picker roller, in which the needle roller is located downstream, relative to a tobacco conveying direction, of the conveyor to receive tobacco material from the conveyor, and the picker roller is arranged to expel tobacco material out of the needle roller in a direction of the portioner, and in which the needle roller is divided into a plurality of needle roller segments adjacently arranged along a length of the needle roller and the picker roller is divided into a respective plurality of picker roller segments aligned with the plurality of needle roller segments, and the method comprises:

receiving, in needles of the plurality of needle roller segments, the tobacco material having a moisture content of at least 35% from the conveyor; and expelling, via the plurality of picker roller segments, the tobacco material out of the needles of the needle roller segments, whereby the portioner is arrange to receive homogenized, moist tobacco material from the picker roller and to receive at least one portion bag to be filled with the received homogenized, moist tobacco material.

11. The method in accordance with claim 10, wherein the portioner comprises a plurality of portioning segments aligned with the plurality of picker roller segments, and wherein the tobacco material expelled via the plurality of picker roller segments is respectively directed to the plurality of portioning segments.

12. The method in accordance with claim 10, further comprising dosing the tobacco material into the needles of the plurality of needle roller segments.

13. The method according to claim 10, wherein the portioner comprises a plurality of portioning segments, and the method further comprises:

receiving, in each portioning segment, the homogenized, moist tobacco material expelled by a respective picker roller segment.

* * * * *